US011598260B2

(12) United States Patent
Hayakawa

(10) Patent No.: US 11,598,260 B2
(45) Date of Patent: Mar. 7, 2023

(54) SOUND PROOF BOX FOR AN ENGINE-DRIVEN WORK MACHINE

(71) Applicant: HOKUETSU INDUSTRIES CO., LTD., Niigata (JP)

(72) Inventor: Tasuku Hayakawa, Niigata (JP)

(73) Assignee: HOKUETSU INDUSTRIES CO., LTD., Niigata (JP)

( * ) Notice: Subject to any disclaimer, the term of this patent is extended or adjusted under 35 U.S.C. 154(b) by 0 days.

(21) Appl. No.: 17/579,524

(22) Filed: Jan. 19, 2022

(65) Prior Publication Data

US 2022/0307415 A1 Sep. 29, 2022

(30) Foreign Application Priority Data

Mar. 26, 2021 (JP) ..... JP2021-053965

(51) Int. Cl.
*F02B 77/13* (2006.01)
*F01P 5/04* (2006.01)
*F02B 63/04* (2006.01)

(52) U.S. Cl.
CPC ..... *F02B 77/13* (2013.01); *F01P 5/04* (2013.01); *F02B 63/04* (2013.01)

(58) Field of Classification Search
CPC ..... F02B 77/13; F02B 63/00; F02B 63/04; F01P 1/00; F01P 5/04
See application file for complete search history.

(56) References Cited

U.S. PATENT DOCUMENTS 5,297,517 A * 3/1994 Brandt ..... F02B 77/13 181/204
5,433,175 A * 7/1995 Hughes ..... F02B 77/13 181/204
5,642,702 A * 7/1997 Kouchi ..... F02B 77/13 181/204
2019/0353081 A1* 11/2019 Sarder ..... F01P 1/02

FOREIGN PATENT DOCUMENTS

CN 1232920 * 10/1999
CN 113914996 * 1/2022
JP 2012-219704 A 11/2012

* cited by examiner

*Primary Examiner* — Syed O Hasan
(74) *Attorney, Agent, or Firm* — Ronald M. Kachmarik; Cooper Legal Group LLC

(57) ABSTRACT

A cooling air introduction path is formed in a base of a sound proof case of an engine-driven work machine. The base is divided into upper and lower portions, and a space in the upper portion is divided by a separation wall and arranged below an air discharging chamber. The upper part of one space is covered with a arranging plate, a partition wall is erected on the arranging plate, and a cooling air introduction port is provided between the partition wall and the separation wall to provide an engine chamber and one space are communicated, a hole is provided in the plate below the chamber, and one space and the space in the lower portion are communicated and located below the chamber. A cooling air intake port is provided on lateral walls of the lower portion to communicate the space inside the lower portion with the outside of the machine.

17 Claims, 9 Drawing Sheets

SOUND PROOF BOX FOR AN ENGINE-DRIVEN WORK MACHINE

BACKGROUND OF THE INVENTION

1. Field of the Invention

The present invention relates to a sound proof box for an engine-driven work machine (service machine) such as a compressor or generator which is equipped with an engine as a driving source, and more particularly to a sound proof box for an engine-driven work machine characterized in a structure of a cooling air introduction flow path provided in the sound proof box.

2. Description of the Related Art

An engine-driven work machine such as a compressor or generator which is provided with an engine as a driving source is usually configured as a sound proof work machine that prevents noise during operation from leaking out of the machine and is packaged by housing constituent equipment such as an engine or a work machine main body in a sound proof box in consideration of the convenience for transportation and installation.

Configurational examples of a sound proof box 310 for such an engine-driven work machine 300 are shown in FIGS. 7 and 8.

The sound proof box 310 shown in FIGS. 7 and 8 is composed of a plan-view rectangular base 320 on which to arrange constituent equipments of an engine-driven work machine 300, such as an engine 351 and a work machine main body (a generator main body in the example shown in the FIGS. 352, and a sound proof case 330 that covers the base 320 in a state where the constituent equipment is arranged thereon.

The space inside this sound proof case 330 is separated into two chambers back and forth in the longitudinal direction of a sound proof box 310 by a partition wall 312 vertically erected on a base 320, and one chamber of those is made to be an engine chamber 330*a* that houses an engine 351 and a work machine main body (a generator main body) 352, and the other chamber is made to be an air discharging chamber 330*b* that communicates with the outside of the machine through an air discharging port 335 provided on a top panel 334.

Further, it is configured to communicate an engine chamber 330*a* and an air discharging chamber 330*b* with each other by a communication port (not shown) provided in the central part of the aforementioned partition wall 312, and to dispose a radiator of an engine 351 in a manner of facing this communication port and, in the case where the engine 351 is equipped with a supercharger, a heat exchanger 354 such as an intercooler or the like of the supercharger to provide a cooling fan 355 for introducing cooling air into this heat exchanger 354 to generate cooling air going from the engine chamber 330*a* to the air discharging chamber 330*b* by this cooling fan 355 and to introduce the cooling air after it exchanges heat with the heat exchanger 354 into the air discharging chamber 330*b*, and to allow the cooling air introduced into the air discharging chamber 330*b* to be discharged outside the machine through the air discharging port 335 provided on the top panel 334.

As mentioned above when a cooling fan 355 is rotated to generate a flow of cooling air which goes from the engine chamber 330*a* to the air discharging chamber 330*b*, pressure becomes negative inside the engine chamber 330*a*, and therefore, outside air is introduced from outside the machine into the engine chamber 330*a* as cooling air.

Such introduction of cooling air from outside the machine is generally performed through an air intake port 327 provided on the lateral wall of a sound proof case 330 as shown in FIGS. 7 and 8.

In this case, if an air intake port 327 is merely provided on the lateral wall of a sound proof case 330, noise generated by an engine 351, a work machine main body 352 or the like directly leaks out of the machine through the air intake port 327.

In addition, when an engine-driven work machine 300 is used outdoors in the rain in the case where outside air is introduced into an engine chamber 330*a* through an air intake port 327 provided on the lateral wall of a sound proof case 330 in this manner, there is a risk that rainwater may enter the engine chamber 330*a* together with outside air through the air intake port 327 and wet the constituent equipment.

Particularly, a configuration in which an oil reservoir is provided in the base 320 of a sound proof box 310 so as to function as an oil weir in order to prevent the fuel, lubricating oil and so forth leaked out of equipment such as an engine 351, a work machine main body 352 and a fuel tank (not shown) from leaking outside the machine causes the disposal costs for disposing of accumulated rainwater to accrue since, once the rainwater that has entered through an air intake port 327 accumulates in the oil reservoir provided in the base 320, then the accumulated rainwater is polluted through being mixed with the leaked oil in the oil reservoir to preclude itself from being subjected to waste water disposal as it is.

In addition, if rainwater accumulates in an oil reservoir, there is even a risk that since no capacity remains in the oil reservoir to receive leaked oil when a leak of fuel or lubricating oil occurs, the leaked oil may overflow from the oil reservoir and pollute the surrounding environment thereof.

Therefore, in the case of providing an air intake port on the lateral wall of the sound proof case 330, it is necessary to provide a duct 360 inside the air intake port 327 as shown in FIG. 8(*b*) to prevent noise from leaking to the outside of the machine and take measures for preventing rainwater from entering the engine chamber 330*a* through the air intake port 327.

Thus, in a configuration in which an air intake port 327 is provided on the lateral wall of a sound proof case 330, it is necessary to provide a duct 360 inside the air intake port 327, and therefore, in the case where it is not possible to secure a space for providing a duct 360 inside the air intake port 327 due to restrictions on the external shape or internal space of a sound proof box 310, the configuration in which an air intake port 327 is provided on the lateral wall of the sound proof case 330 cannot be adopted.

For this reason, instead of a sound proof box for an engine-driven work machine which is configured to be provided with an air intake port on the lateral wall of a sound proof case, one that has a cooling air introduction flow path formed on the base has been also proposed.

As the base of such a sound proof box, the base 470 shown in FIG. 9 is disclosed in Japanese Patent KOKAI No. 2012-219704. (LOPI; automatically published after around 18 months from filing date regardless prosecution)

This base 470 is composed of a bed 480 on which to arrange an engine and a work machine main body, and a wheeled oil guard 490 on which to arrange the bed 480, and in the oil guard 490, ducts 494 and 494 are formed between the longitudinal outer walls 491 and 491 of the oil guard 490 and the lateral walls 493 and 493 of the oil reservoir 492 which are provided in parallel with the outer walls 491 and 491, and the ducts 494 and 494 are made to communicate with the outside of the machine through an air intake port 495 provided in the outer walls 491 and 491 of the oil guard 490.

Although these ducts 494, 494 are separated by the partition plates 496 each of which is provided in front of and behind the position at which to dispose each wheel, these partition plates 496 are formed lower than the outer wall 491 of an oil guard 490 and the lateral wall 493 of an oil reservoir 492 and thereby the ducts 494, 494 communicate with of a space 497 of a wheel upper portion.

Further, the aforementioned bed 480 which is arranged on an oil guard 490 has sack-shaped flow paths 481, 481 surrounded by a wall surface on the top, bottom, front, back, left and right sides, formed in the part where it is placed on the aforementioned duct 494, and through an opening 482 formed in the bottom wall of the sack-shaped flow paths 481, the sack-shaped flow paths 481 communicate with a duct 494 directly or through the space 497 of the wheel upper portion, and the sack-shaped flow path 481 communicates with the space inside a sound proof case through the opening 483 provided on the lateral wall of the sack-shaped flow path 481.

This is why a cooling air introduction flow path which goes from the air intake port 495 through the duct 494, the space 497 of the wheel upper portion, the opening 482 provided on a bed 480, the sack-shaped flow path 481 and the opening 483 to the space inside the sound proof case (not shown in the drawings) has been formed in a base 470.

In the cooling air introduction flow path described in the above mentioned '219704, a cooling air introduction flow path in a complex shape is formed from an air intake port 495 provided on the outer wall 491 of an oil guard 490 to an opening 483 provided in a bed 480, and thereby noise generated in the sound proof box is prevented from leaking directly outside the machine through the air intake port 495.

Additionally, even if rainwater passes through an air intake port 495 together with cooling air by going through a flow path in a bent shape and by the outside air flowing from the lower side toward the upper side through the inside of a base 470 to an opening 483 provided in a bed 480, the rainwater will drop out of the cooling air before reaching the opening 483 so as to be removed, and thereby, rainwater is favorably prevented from entering a sound proof case.

However, in the base 470 of the sound proof box described in the '219704, a structure of forming a duct 494 in an oil guard 490 by separately providing a lateral wall 493 of an oil reservoir 492 besides a longitudinal outer wall 491 and separating the duct 494 by a partitioning plate 496 at a plurality of locations is adopted, and a complicated structure such as one wherein to form a sack-shaped flow path 481 at a position above the duct 494 is adopted on the side of a bed 480, in order to form the aforementioned inlet flow path in a complicated shape.

Therefore, since the configuration described in the '219704 is complicated in structure and requires many workloads that many components need to be attached by welding work or the like in order to form a flow path for introducing cooling air, it is high in manufacturing costs.

In addition, after a sound proof box is assembled, a duct 494 and the space 497 of the wheel upper portion are covered by the bottom plate of a bed 480, and the bed 480 is also provided with a sack-shaped flow path 481, and therefore, it is difficult to access the inside of a cooling air introduction flow path from the outside.

Therefore, dust sucked together with cooling air accumulates in a duct 494 or a sack-shaped flow path 481, and in the case where a foreign matter such as sucked litter is clogged in the duct 494 or the sack-shaped flow path 481, these are extremely difficult to remove, and the maintainability is poor.

Then, the present invention has been made in order to resolve a defect in the above-mentioned conventional art and the first object of the present invention is to provide a sound proof box for an engine-driven work machine which is relatively simple in structure and is equipped with a cooling air introduction flow path capable of introducing a sufficient volume of cooling air into the base without compromising the sound insulation and waterproofness of the sound proof box.

Additionally, the second object of the present invention is to provide a sound proof box for an engine-driven work machine in which a cooling air introduction flow path configured as described above can be provided in a base equipped with an oil reservoir to have the function of an oil weir without compromising the function of the oil reservoir.

Furthermore, the third object of the present invention is to provide a sound proof box for an engine-driven work machine which is so excellent in maintainability that even in the case where dust or the like accumulates in or a foreign matter is sucked into a cooling air introduction flow path, it can be easily subjected to removal or the like.

SUMMARY OF THE INVENTION

Means for solving the problems are described below with reference numerals used in the detailed description of the preferred embodiments. These reference numerals are intended to clarify the correspondence between the descriptions in the claims and the descriptions in the detailed description of the preferred embodiments, and it is needless to say that these reference numerals should not be used to restrictively interpret the technical scope of the present invention.

In order to achieve the First object, a sound proof box 10 for an engine-driven work machine 1 of the present invention comprises a base 20 arranging an engine 51 and a work machine main body 52 driven by the engine 51 and whose upper portion is opened, and a sound proof case 30 for covering the upper side of the base 20, and a space in the sound proof case 30 being separated into two chambers by a vertically erected partition wall 12 to make one chamber as an engine chamber **30*a* housing the engine 51 and the work machine main body 52 and make the other chamber as an air discharging chamber 30*b* introducing the cooling air from the engine chamber 30*a* through a communication port 13 provided on the partition wall 12 and discharging to outside of the machine through an air discharging port 35, an upper opening of the base 20 being covered with a component arranging plate 14 at a position at which to place the air discharging chamber 30*b*, to form a bottom surface of the air discharging chamber 30*b* by the component arranging plate 14, an inside of the base 20 being separated into an upper stage and a lower stage by a floor plate 22 at a predetermined position in the height direction to make the upper stage side of the base 20 which includes the floor plate 22 as an upper stage portion 20*a* and make the part lower than the floor plate 22 of the base 20 as a lower stage portion 20*b*, a separation wall 24 to divide a space 23 in the upper stage portion 20***a* in the longitudinal direction being provided at a position below the engine chamber 30*a* to make the space 23 in the upper stage portion 20*a* which is a space closer to the air discharging chamber 30*b* than the separation wall 24 as one space, a cooling air introduction port 15 which communicates the engine chamber 30*a* with the one space being provided between the partition wall 12 and the separation wall 24, a through hole 25 which communicates the one space 23*a* with a space in the lower stage portion 20*b* being provided at a bottom portion of the one space 23*a* at a position below the air discharging chamber 30*b*, and a cooling air intake port 27 which communicates the space in the lower stage portion 20*b* with the outside of the machine being provided on lateral walls (211*b*, 212*b*) of the lower stage portion 20*b* (see FIGS. 1 to 6).

It is preferable that the cooling air intake port 27 is provided in the lateral walls (211*b*, 212*b*, 213*b*, 214*b*) of the lower stage portion 20*b* which is any part located below the engine chamber 30*a*.

Each of the upper stage portion 20*a* and the lower stage portion 20*b* may be formed as a discrete member, and that the base 20 is formed by arranging the upper stage portion 20*a* on the lower stage portion 20*b*.

The air intake port which is also used as a fork insertion port of a forklift may be provided on the lateral walls of the lower stage portion 20*b* which are the longitudinal lateral walls (211*b*, 212*b*) thereof.

Furthermore, the introduction port 15 may be covered with a mesh-like cover 16 (see FIGS. 1 and 2).

Moreover, in order to achieve the Second object, a sound proof box 10 for an engine-driven work machine 1 of the present invention is characterized in that a space in the upper stage portion 20*a* divided by the separation wall 24 which is the other space 23*b* therein is formed as a liquid-tight chamber to make an oil reservoir for reserving leaked oil.

Furthermore, in order to achieve the Third object, a sound proof box 10 for an engine-driven work machine 1 is characterized in that an inspection port 28 is further provided in the part of the lateral walls 211, 212, 213, 214 of the base 20 wherein the one space 23*a* is formed (one widthwise lateral wall 213*a* at the air discharging chamber 30*b* in the example in the drawings), and that a cover 29 for covering the inspection port 28 is provided (see FIG. 2).

Effect of the Invention

The configuration of the present invention which is described above has allowed the following remarkable effects to be obtained with the sound proof box 10 of the engine-driven work machine 1 of the present invention.

The inside of the base 20 of a sound proof box 10 is separated into an upper stage portion 20*a* and a lower stage portion 20*b* by a floor plate 22 at a given position in the height direction, a separation wall 24 dividing a space 23 inside the upper stage portion in the longitudinal direction is provided to set the space 23 divided by the separation wall 24 which is a space disposed closer to an air discharging chamber 30*b* than the separation wall 24 as one space 23*a*, a cooling air introduction port 15 communicating an engine chamber 30*a* with the one space 23*a* is provided between the partition wall 12 and the separation wall 24, a through hole 25 communicating the one space 23*a* with a space in the lower stage portion 20*b* is provided at the bottom portion of the one space 23*a* positioned below the air discharging chamber 30*b*, a cooling air intake port 27 communicating a space in the lower stage portion 20*b* with the outside of the machine is provided on the lateral walls (211*b*, 212*b*, 214*b*) of the lower stage portion 20*b*, and thereby, a cooling air introduction flow path going from the air intake port 27 to the introduction port 15 can be formed in the base 20.

As a result, when a flow of cooling air from the engine chamber 30*a* toward the exhaust air chamber 30*b* is generated by the blower 55 provided in the sound proof box 10 to create a negative pressure in the engine chamber 30*a*, the air outside the machine which is introduced through the air intake port 27 can be introduced into the engine chamber 30*a* through the internal space of the lower stage portion 20*b*, the through hole 25, one space 23*a* of the upper stage portion 20*a*, and the introduction port 15 provided on the component arranging plate 14.

As shown in FIGS. 3 and 6, this cooling air introduction flow path is formed in a manner of meandering inside a base 20, and thereby, the noise generated inside a sound proof box 10 cannot leak directly outside the machine through an air intake port 27, and therefore, a cooling air introduction flow path can be formed inside the base 20 without compromising the sound insulation of the sound proof box 10.

Additionally, even if as shown in FIGS. 3 and 6, the cooling air flowing through this cooling air introduction flow path forms a flow meandering upward from the lower side to the upper side inside the base 20 to make rainwater pass through the air intake port 27 by being carried by the cooling air, this rainwater drops out of the flow of the cooling air before reaching the introduction port 15 and falls down so as to be removed, to allow the entrance of rainwater into an engine chamber 30*a* to be prevented.

In addition, a cooling air introduction flow path can be formed in a base 20 in this way, and thereby, a cooling air intake port 327 does not necessarily need to be provided on the lateral walls of a sound proof case 330 as in the conventional sound proof box 310 described with reference to FIGS. 7 and 8, and additionally, even in the case of providing a cooling air intake port 327 on the lateral wall of the sound proof case 330, the air intake port 327 is allowed to be reduced in size and in number, and therefore, it is not necessary any more to provide a duct 360 on the inner surface of the lateral wall of a sound proof case, or it is made to be possible to reduce the duct 360 in size and number, and thereby, it is made to be possible to reduce the sound proof case in size and thus to reduce a whole engine-driven work machine in size.

In the configuration wherein an upper stage portion 20*a* and a lower stage portion 20*b* of the base 20 are formed as separate members and wherein the base 20 is formed by arranging the upper stage portion 20*a* on the lower stage portion 20*b*, a cooling air introduction flow path can be formed more easily in a base 20.

Additionally, in the configuration wherein the air intake port 27 which is shared with a fork insertion port of a forklift is provided on the lateral walls of the lower stage portion 20*b* which are the longitudinal lateral walls (211*b*, 212*b*), the air intake port 27 does not need to be formed separately from the fork insertion port, and thereby the workloads required for manufacturing can be reduced.

In the configuration wherein the introduction port 15 is covered with a mesh-like cover 16, even in the case where a foreign matter such as litter is sucked in, the foreign matter can be collected by the mesh-like cover 16 before it enters an engine chamber 30*a*, and therefore, the occurrence of a serious failure or the like caused by the sucked litter getting entangled in the fan of a blower 55 in the engine chamber 30*a* can be prevented in advance.

In the configuration wherein the other space 23*b* in the upper stage portion 20*a* divided by the separation wall 24 is formed as a liquid-tight chamber and used as an oil reservoir for reserving leaked oil, an oil reservoir 23*b* can be easily provided in a base 20, and without carrying out any processing such as drilling on the wall surface of the oil reservoir 23*b* part, that is, without compromising the liquid-tightness of the oil reservoir 23*b*, a cooling air introduction flow path can be relatively easily formed in the base 20.

Furthermore, in the configuration wherein an inspection port 28 is provided on the part of the lateral walls 211, 212, 213, 214 of the base 20 in which the one space 23*a* is formed (in the example shown, one lateral wall 213 present on the side toward an air discharging chamber 30*b*), and wherein a cover 29 to cover the inspection port 28 is provided, a cooling air introduction flow path can be easily accessed by simply removing the cover 29 without removing a sound proof case 30 or removing a component arranging plate 14, and even in the case or the like where dusts accumulate on or foreign matters such as litters are sucked into the cooling air introduction flow path, these can be easily removed to greatly improve maintainability.

BRIEF DESCRIPTION OF THE DRAWINGS

The objects and advantages of the invention will become understood from the following detailed description of preferred embodiments thereof in connection with the accompanying drawings in which like numerals designate like elements, and in which.

DETAILED DESCRIPTION OF THE PREFERRED EMBODIMENTS

The sound proof box for an engine-driven work machine of the present invention is described below with reference to the accompanying drawings.

Figure 1:
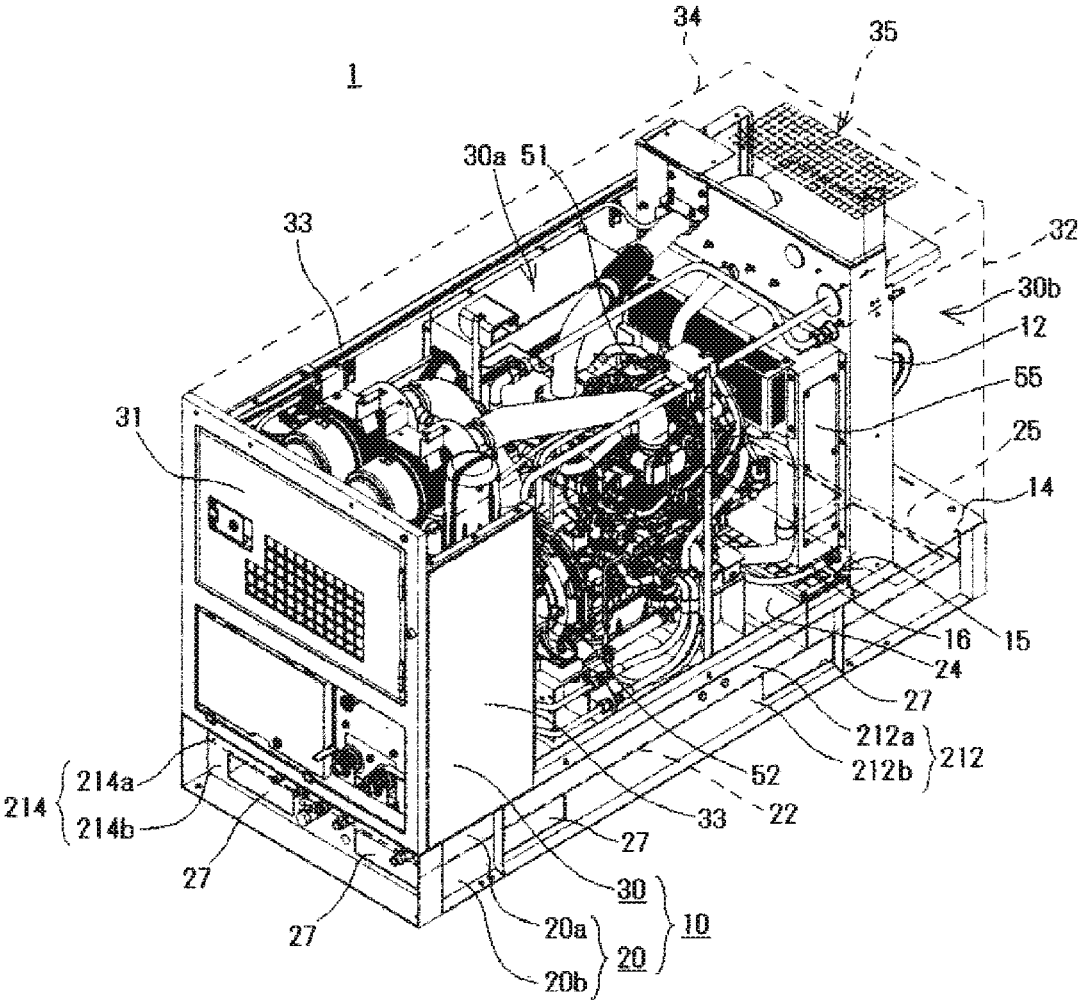
FIG. 1 is a perspective view from the front side obtained by viewing an engine-driven work machine equipped with a sound proof box as one embodiment of the present invention.
Figure 2:
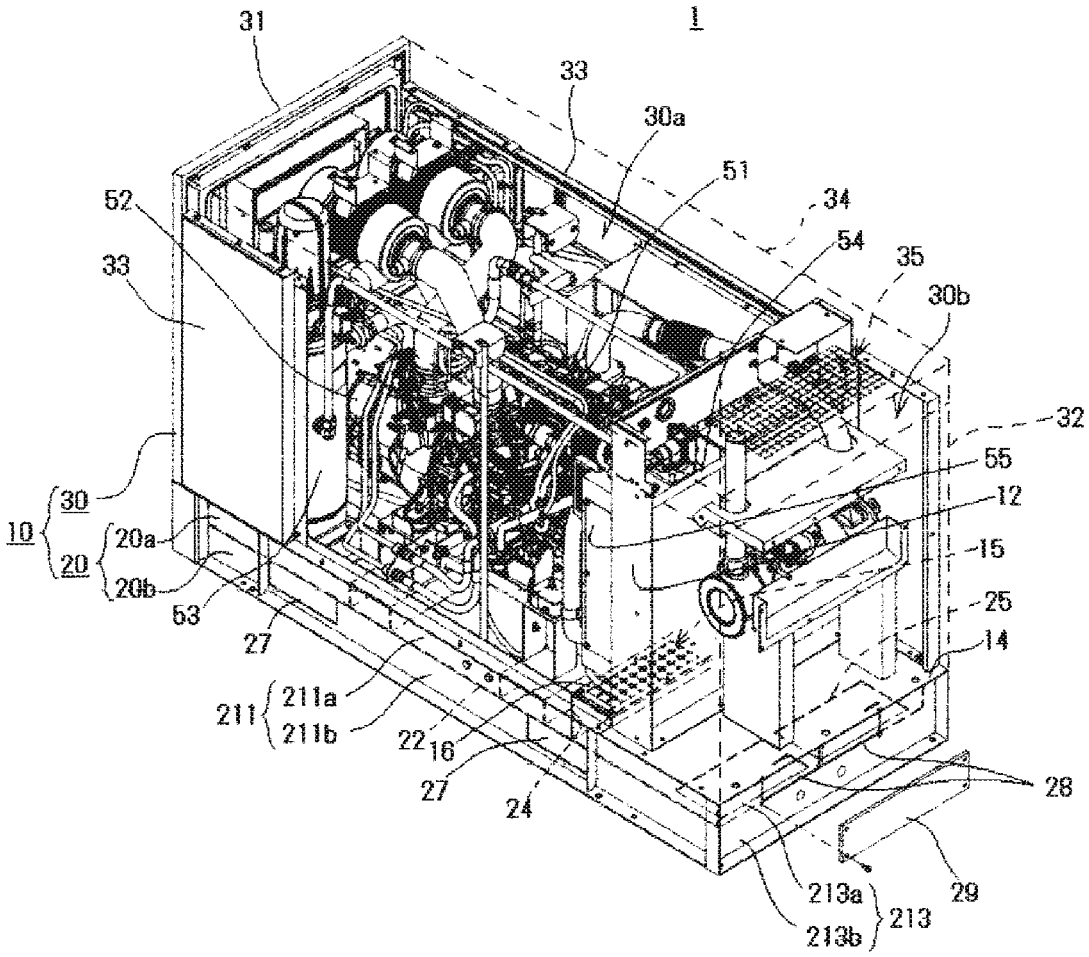
FIG. 2 is a perspective view from the rear side obtained by viewing an engine-driven work machine equipped with a sound proof box as one embodiment of the present invention.

The reference numeral 1 in FIGS. 1 and 2 indicates an engine-driven work machine equipped with the sound proof box 10 of the present invention.

This engine-driven work machine 1 is one packaged in the sound proof box 10 by housing the constituent equipment of the engine-driven work machine 1, such as an engine 51, a work machine main body (in the example shown in the figure, the main body of a compressor) 52 and a receiver tank 53, and is thereby configured to be capable of preventing leakage of noise generated in the sound proof box 10 and facilitating the transportation and installation.

The aforementioned sound proof box 10 which houses the constituent equipment of the engine-driven work machine 1 is composed of a plan-view rectangular base 20 on which to arrange the aforementioned engine 51, the work machine main body 52, and other constituent equipment, and a sound proof case 30 that covers the base 20 in the state where the constituent equipment is arranged thereon.

A sound proof case 30 among them is a box-shaped case consisting of a front panel 31, a rear panel 32, a side panel 33, and a top panel 34, and by arranging the sound proof case 30 on the base 20, a housing space to house the constituent equipment arranged on the base 20 is formed in the sound proof case 30.

In the sound proof case 30 shown in FIGS. 1 and 2, the rear panel 32, a part of the side panel 33 on the front side of the drawing, and the top panel 34 are in the state of being removed, and in the state where these members are arranged, the entire case is formed in the shape of a rectangular box, as shown by the dashed lines in FIGS. 1 and 2.

The space inside this sound proof case 30 is divided into two chambers back and forth in the longitudinal direction of a sound proof box 10 by a partition wall 12 vertically erected from the upper face of a base 20 in order to form an engine chamber 30*a* where the engine 51, the work machine main body 52 and so forth are housed on the side toward a front panel 31, and an air discharging chamber 30*b* which communicates with the outside of the machine through an air discharging port 35 on the side toward a rear panel 32.

The above-mentioned engine chamber 30*a* and air discharging chamber 30*b* communicates with each other through a communication port 13 (see FIGS. 3 and 5) provided in the central part of the partition wall 12, and the air discharging chamber 30*b* communicates with the outside of the machine through an air discharging port 35 provided in the top cover 34 as shown in FIGS. 1 and 2.

The above-mentioned base 20 on which to arrange the engine 51, the work machine main body 52 and other constituent equipment of the engine-driven work machine 1 is formed in a plan-view rectangular shape formed by being bounded on four sides by a pair of longitudinal lateral walls 211, 212 and a pair of widthwise lateral walls 213, 214, and the space inside the base 20 which is formed by being enclosed by these lateral walls 211-214 is divided by a floor plate 22 into upper and lower two stages at a given position in the height direction.

As for the base 20 divided into upper and lower stages by the floor plate 22, the present specification describes the upper stage side including the floor plate 22 as the upper stage portion 20*a*, and the part below the floor plate 22 as the lower stage portion 20*b*.

Therefore, as shown in FIGS. 1 and 2, one longitudinal lateral wall 211 of a base 20 has its upper portion side forming one longitudinal lateral wall 211*a* of an upper stage portion 20*a*, and has its lower portion side forming one longitudinal lateral wall 211*b* of a lower stage portion 20*b* (see FIG. 2), the other longitudinal lateral wall 212 of the base 20 has its upper portion side forming the other longitudinal lateral wall 212*a* of the upper stage portion 20*a*, and has its lower portion side forming the other longitudinal lateral wall 212*b* of the lower stage portion 20*b* (see FIG. 1), one widthwise lateral wall 213 of the base 20 has its upper portion side forming one widthwise lateral wall 213*a* of the upper stage portion 20*a*, and has its lower portion side forming one widthwise lateral wall 213*b* of the lower stage portion 20*b* (see FIG. 2), and the other widthwise lateral wall 214 of the base 20 has its upper portion side forming the other widthwise lateral wall 214*a* of the upper stage portion 20*a*, and has its lower portion side forming the other widthwise lateral wall 214*b* of the lower stage portion 20*b* (see FIG. 1).

Figure 3:
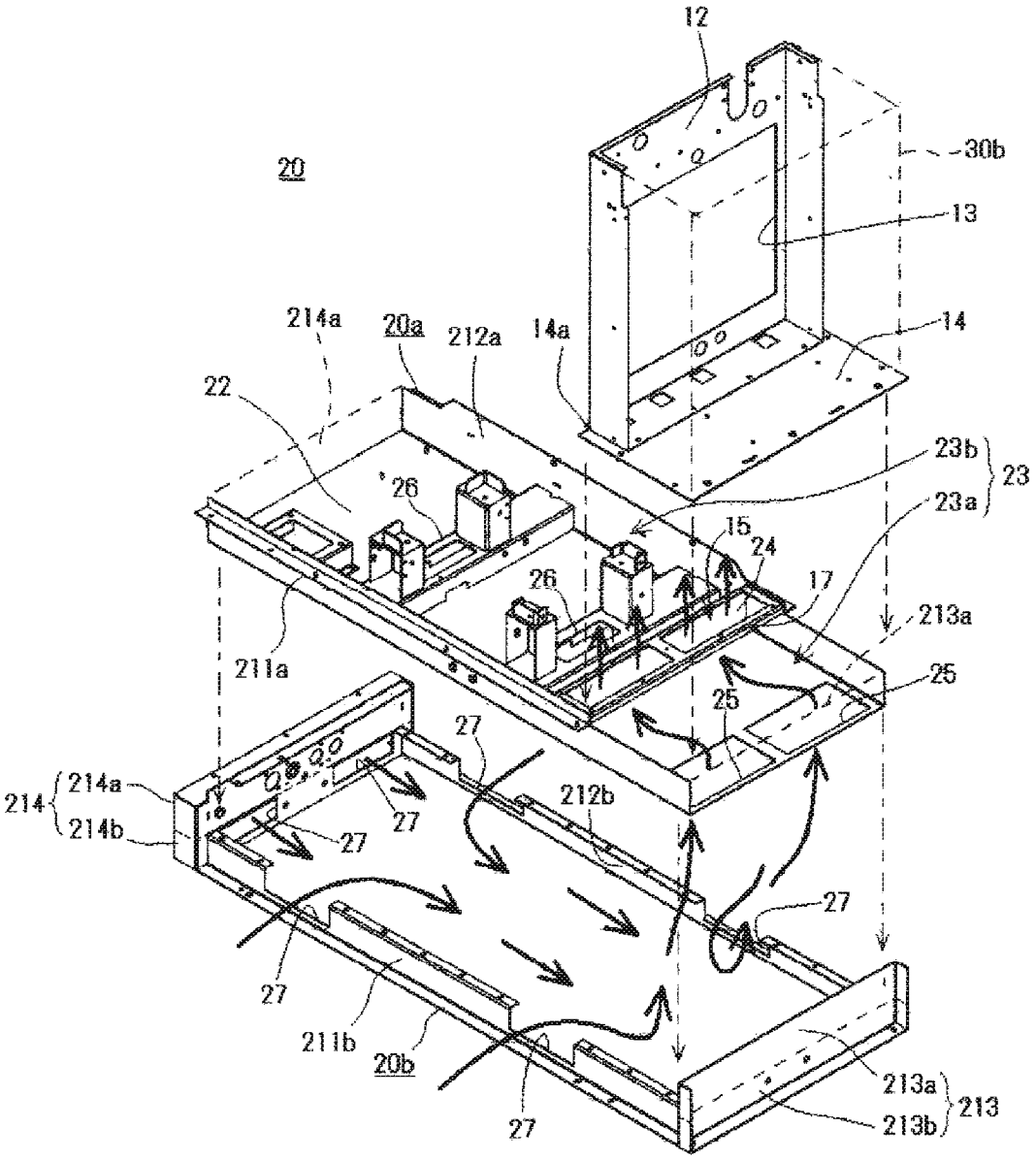
FIG. 3 is an exploded view from the rear side obtained by viewing the base of a sound proof box as one embodiment of the present invention.
Figure 5:
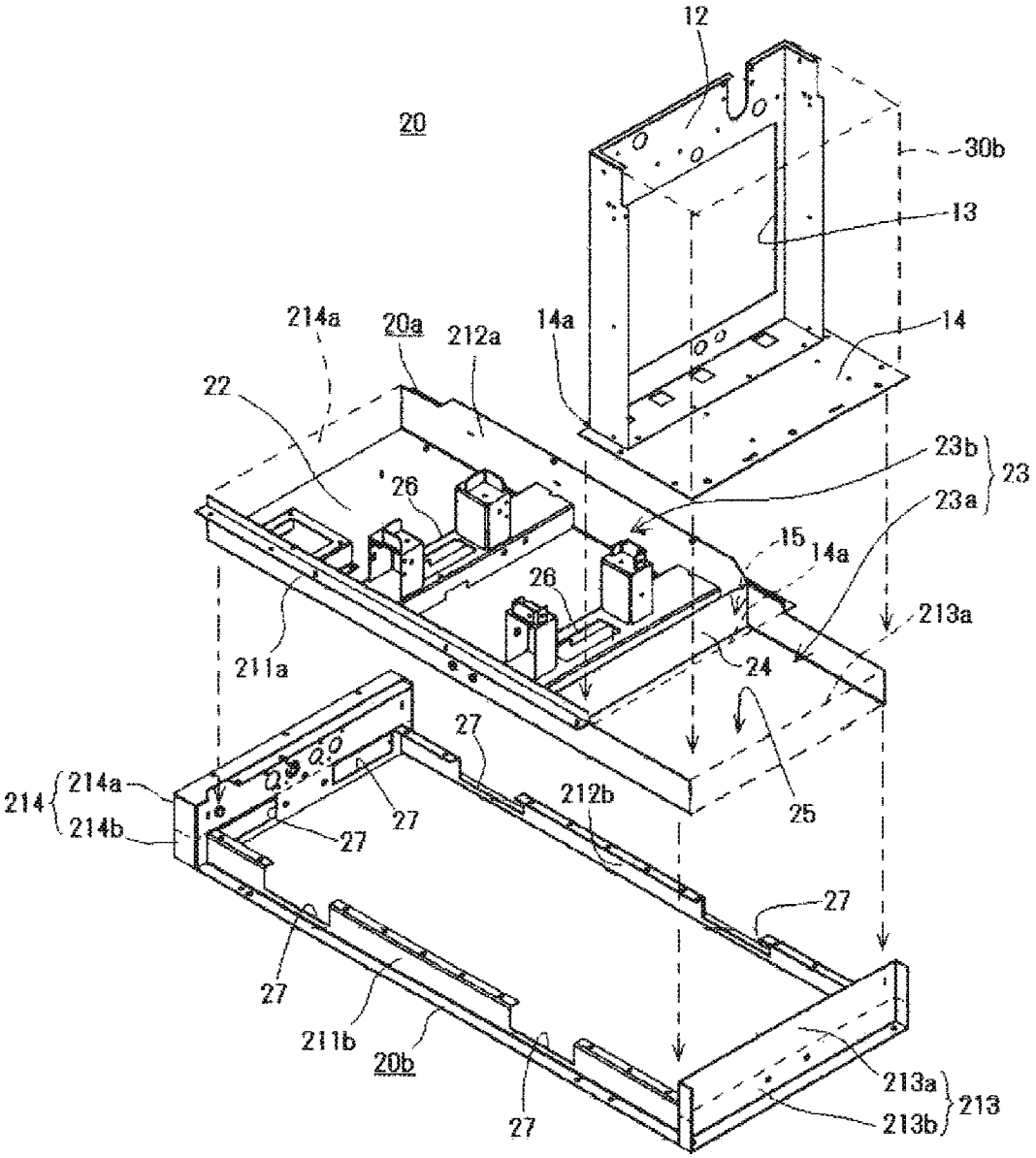
FIG. 5 is an exploded view from the rear side obtained by viewing the base of a sound proof box as another embodiment of the present invention.

This embodiment is configured so that as shown in FIGS. 3 and 5, the parts of the upper stage portion 20*a* except for the widthwise lateral walls 213*a*, 214*a* and the lower stage portion 20*b* of the frame type formed by combining four molding members are each formed as separate members, that the longitudinal end edge part of the floor plate 22 of the upper stage portion 20*a* is arranged on the longitudinal lateral walls 211*b* and 212*b* of the lower stage portion 20*b*, and that the base 20 can be formed by fixing both of the members together by bolting, welding, or other methods.

As shown in FIGS. 3 and 5, this embodiment is configured that the longitudinal lateral walls 211*a*, 212*a* of the upper stage portion 20*a* and the longitudinal lateral walls 211*b*, 212*b* of the lower stage portion 20*b* are each composed of different members, and that when the upper stage portion 20*a* is arranged on the lower stage portion 20*b*, one longitudinal lateral wall 211*a* of the upper stage portion 20*a* and one longitudinal lateral wall 211*b* of the lower stage portion 20*b* form one longitudinal lateral wall 211 of the base 20, and the other longitudinal lateral wall 212*a* of the upper stage portion 20*a* and the other longitudinal lateral wall 212*b* of the lower stage portion 20*b* form the other longitudinal lateral wall 212 of the base 20.

On the other hand, each of the widthwise lateral walls 213 and 214 of a base 20 is formed by one mold plate, and is configured so that the mold plate (a lateral wall 213 or 214) is attached to the part of a lower stage portion 20*b* in the state before the base 20 is assembled.

Further, a configuration in which when the part of an upper stage portion 20 except for widthwise lateral walls 213*a* and 214*a* is arranged on a lower stage portion 20*b*, the lower parts of these mold plates (widthwise lateral walls 213 and 214) form the widthwise lateral walls 213*b* and 214*b* of the lower stage portion 20*b* and the upper parts thereof form widthwise lateral walls 213*a* and 214*a* of the upper stage portion 20*a* has been made.

However, the configurations of lateral walls 211-214 of a base 20 are not limited to the configurations shown in FIGS. 3 and 5, and longitudinal lateral walls 211 and 212 as well as widthwise lateral walls 213 and 214 may also be formed of one mold plate, and furthermore, the widthwise lateral walls 213 and 214 may also be formed by combining the widthwise lateral walls 213*a*, 214*a* of the upper stage portion 20*a* and the widthwise lateral walls 213*b*, 214*b* of the lower stage portion 20*b* which are formed as separate members in the same way as the longitudinal lateral walls 211 and 212.

As shown in FIGS. 1-3 and 5, the space 23 formed in the upper stage portion 20*a* is divided into two sections back and forth in the longitudinal direction by a separation wall 24 erected on a floor plate 22 at the position below an engine chamber 30*a*, and one space 23*a* which is present on the side of an air discharging chamber 30*b* with respect to this separation wall 24 and is the upper portion of a part corresponding to the position at which to form the air discharging chamber 30*b* is covered with a component arranging plate 14, and this component arranging plate 14 is used as the bottom surface of the air discharging chamber 30*b*.

Further, the aforementioned partition wall 12 which separates the inside of a sound proof case 30 into an engine chamber 30*a* and an air discharging chamber 30*b* is erected on the side of the end edge 14*a* of the side of the engine chamber 30*a* of that component arranging plate 14.

Between the lower end of the partition plate 12 (the end edge 14*a* on the side of the engine chamber 30*a* of the component arranging plate 14) and the upper end of the separation wall 24, the upper portion of one space of an upper stage portion 20*a* is opened by a cooling air introduction port 15, and the engine chamber 30*a* and one space 23*a* in the upper stage portion 20*a* communicates with each other through this introduction port 15.

Figure 4A:
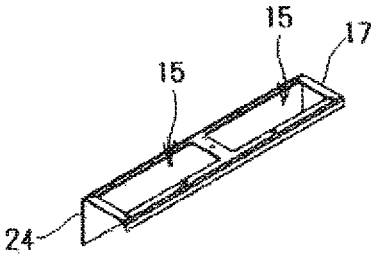
FIG. 4A is a perspective view from the front side obtained by viewing a separation wall 24 and a frame body 17 from the rear side.
Figure 4B:
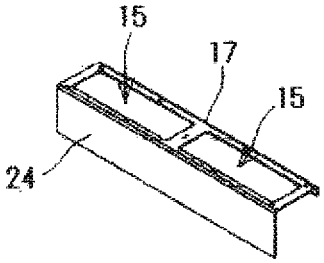
FIG. 4B is a perspective view from the front side obtained by viewing a separation wall 24 and a frame body 17 from the front side.
Figure 4C:
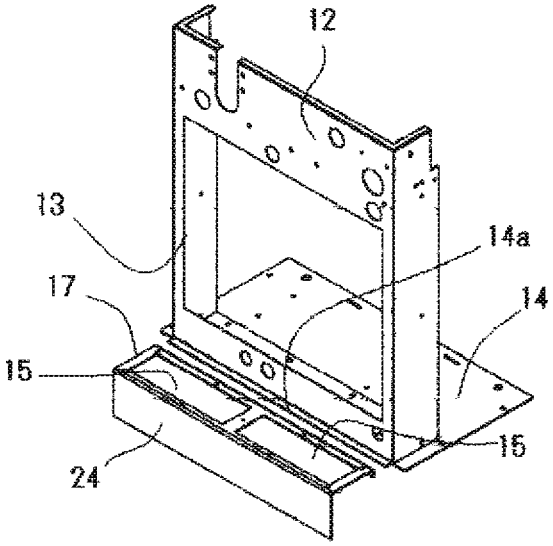
FIG. 4C is a perspective view from the front side obtained by viewing a separation wall 24 and a frame body 17 together with a component arranging plate 14 and a partition wall 12.

In the embodiment shown in FIG. 3, as shown in FIGS. 4A to 4C, a separation wall 24 is formed by one vertical piece of an L-shaped cross-sectional angle plate, and an introduction port 15 is formed in the other piece of the angle plate extending from the upper end of the separation wall 24 toward the lower end of a partition plate 12 (the end edge 14*a* on the engine chamber 30*a* side of a component arranging plate 14), and thereby, the other piece of the angle plate is made to be a frame body 17 to which to attach the mesh-like cover 16 to be described later.

In the configuration described with reference to FIGS. 3 and 4, the aforementioned frame body 17 is explained as being integrally formed with a separation wall 24 and provided so as to protrude from the upper end of the separation wall 24 toward the end edge 14*a* on the engine chamber 30*a* side of a component arranging plate 14, however, although the illustration is omitted, the frame body 17 may be, on the contrary to this, integrally formed with the component arranging plate 14 and provided so as to protrude from the end edge 14*a* on the engine chamber 30*a* side of the component arranging plate 14 toward the upper end of the separation wall 24.

Additionally, the aforementioned frame body 17 does not necessarily need to be provided, and as shown in FIG. 5, the part between the lower end of the partition plate 12 (the end edge 14*a* on the side of the engine chamber 30*a* of the component arranging plate 14) and the upper end of the separation wall 24 may be left open without any attachment so that the entire of this part is used as the aforementioned introduction port 15.

It is preferable to attach a mesh cover 16 to this introduction port 15 as shown in FIG. 1 and FIG. 2 so that even in the case where a foreign matter such as litter is sucked in through a cooling air introduction flow path, it cannot reach an engine chamber 30*a*.

In the part of the aforementioned floor plate 22 provided in an upper stage portion 20*a* which forms the bottom surface of the one space 23*a*, a through hole 25 penetrating through the floor plate 22 is formed, as shown in FIG. 3, below the position at which to form an air discharging chamber 30*b*, and one space 23*a* of the upper stage portion 20*a* and the space in a lower stage portion 20*b* communicate with each other through that through hole 25.

It is preferable that this through hole 25 is provided as far away as possible from an introduction port 15 as shown in FIGS. 1 to 3, for example, at a position close to one widthwise lateral wall 213*a* of an upper stage portion 20*a*.

Although the embodiments shown in FIGS. 1 to 3 show a configuration of covering the entire bottom portion of an upper stage portion 20*a* with the floor plate 22, and forming the aforementioned through hole 25 through the floor plate 22 of the bottom surface part of one space 23*a* of the upper stage portion 20*a*, a configuration of making the entire bottom portion of one space 23*a* as a through hole 25 without providing a floor plate 22 in the part where the one space 23*a* of the upper stage portion 20*a* is formed as shown in FIG. 5 may be adopted instead of that configuration.

The other space 23*b* of the space 23 in the upper stage portion 20*a* separated by the separation wall 24 is formed liquid-tight to be used as an oil reservoir in this embodiment, and such a configuration that the constituent equipment of the engine-driven work machine 1 such as the engine 51 and the work machine main body 52 can be arranged on the arranging table 26 provided in the oil reservoir 23*b* is made, and at the same time, fuel and lubricating oil leaked from the engine 51 and the work machine main body 52 are reserved in the oil reservoir 23*b* to prevent them from leaking outside the machine.

In FIG. 2, the reference numeral of 28 refers to an inspection port provided on one widthwise lateral wall 213 of the base 20, and this inspection port 28 is blocked with a cover 29 when an engine-driven work machine 1 is in operation, and on the other hand, the cover 29 is removed at the time of inspection and thereby dusts accumulated in one space 23*a* of an upper stage portion 20*a*, foreign matters sucked into the portion, or the like can be removed through the inspection port 28.

In the example shown in the figure, a configuration in which the inspection port 28 is provided on one widthwise lateral wall 213 of a base 20 is shown, however the inspection port 28 may also be provided on the part where one space 23*a* is formed among the longitudinal lateral walls 211 and 212 of the base 20.

Additionally, this inspection port 28 and the cover 29 are not essential components in the sound proof box 10 of the present invention and need not be necessarily provided.

In any part of the lateral wall of a lower stage portion 20*b*, preferably the part of the lateral wall of the lower stage portion 20*b* which is located below an engine chamber 30*a*, a cooling air intake port 27 is formed.

In the illustrated embodiment, these air intake ports 27 are provided at six locations, that is, two locations on each of the longitudinal lateral walls 211*b* and 212*b* of a lower stage portion 20*b* and two locations on the other widthwise lateral wall 214*b*, however the positions at which to form the air intake ports 27 are not limited to the illustrated examples and these can be provided at any position on the lateral walls of the lower stage portion 20*b*.

In the illustrated embodiment, the air intake ports 27 provided on the longitudinal lateral walls 211*b* and 212*b* of a lower stage portion 20*b* are formed in accordance with the width of the forks of a forklift so that the air intake ports 27 can be also used as fork insertion ports of a forklift.

By adopting such a configuration, in the case of obtaining, the base 20 of the sound proof box 10 of the present invention by modifying the structure of an already existing base equipped with the fork insertion port, no new air intake port 27 needs to be provided, so that the workloads required during the manufacturing can be reduced.

The sound proof box 10 configured as described above is configured so that on the side of the air discharging chamber 30*b*, a heat exchanger 54 such as a radiator of an engine 51 is placed facing a communication port (not illustrated) provided on a partition wall 12 as shown in FIG. 2 while on the side of the engine chamber 30*a*, a blower 55 having cooling fans (not illustrated) internally is placed through a communication port (not illustrated) toward the aforementioned heat exchanger 54, that once cooling air is generated by operating the blower 55, the air in the engine chamber 30*a* passes through the heat exchanger 54 through a communication port 13 for heat exchange and is thereafter introduced into the air discharging chamber 30*b*, and that the cooling air introduced into the air discharging chamber 30*b* is discharged outside the machine through an air discharging port 35.

In this way, when the air in the engine chamber 30*a* is sent into the side of the air discharging chamber 30*b* by the operation of the blower 55, the inside of the engine chamber 30*a* takes on negative pressure.

Figure 6:
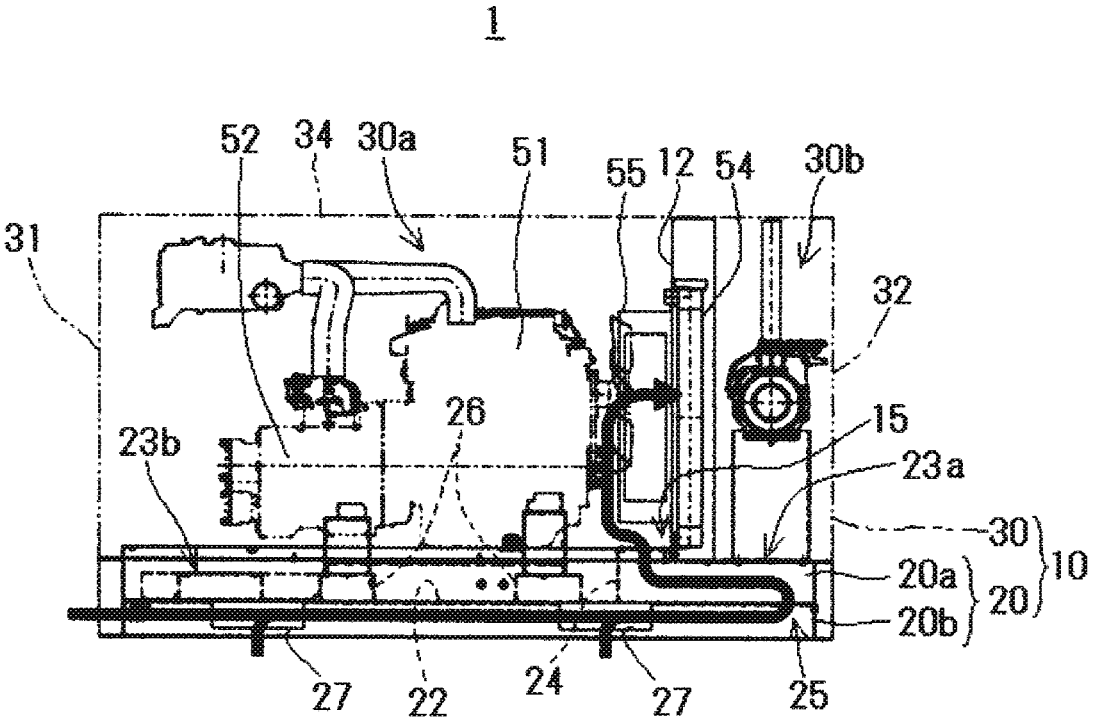
FIG. 6 is a side perspective view of an engine-driven work machine equipped with a sound proof box as one embodiment of the present invention.

As a result, as shown by the arrows in FIG. 3 and FIG. 6, the outside air introduced from the air intake ports 27 provided on the lateral walls 211*b*, 212*b*, and 214*b* of the lower stage portion 20*b* of a base 20 passes through the space inside the lower stage portion 20*b* of the base 20, reaches the inside of one space 23*a* of the upper stage portion 20*a* through a through hole 25, and is introduced into the engine chamber 30*a* through the cooling air introduction port 15 provided on the component arranging plate 14.

In other words, a cooling air introduction flow path going from the air intake port 27 to the introduction port 15 is formed in the base 20.

Figure 7:
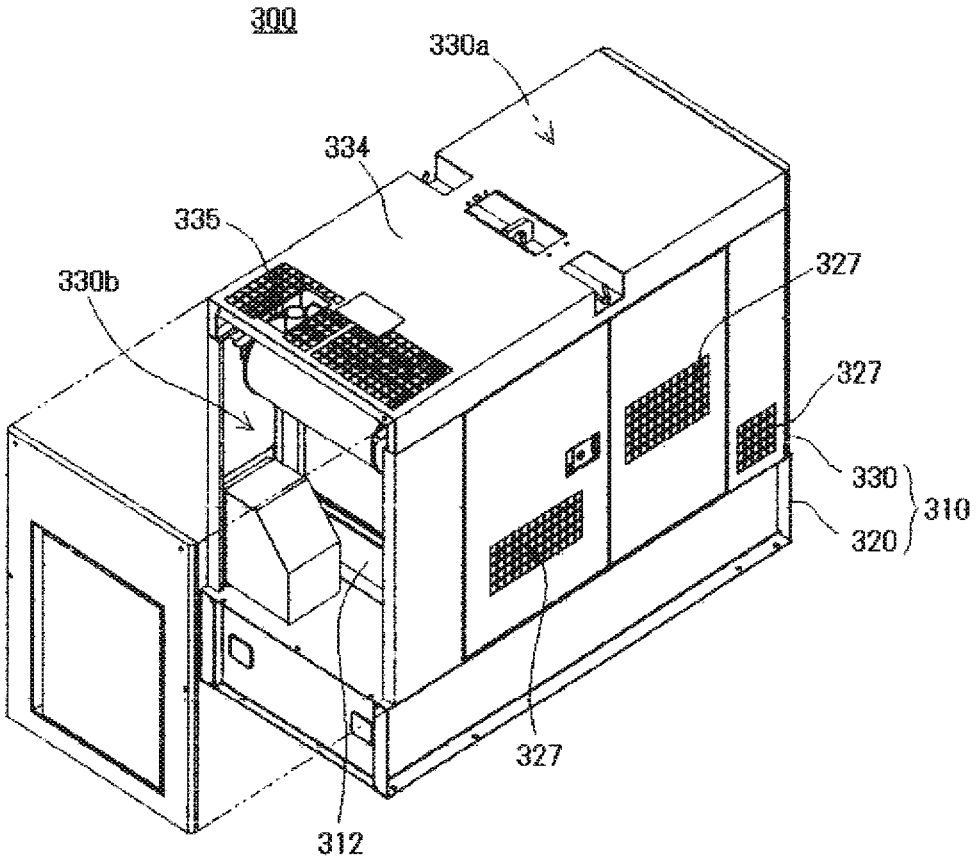
FIG. 7 RELATED ART
FIG. 7 is a perspective view of a conventional sound proof box for an engine-driven work machine which is provided with an air intake port on the lateral wall of a sound proof case.
Figure 8A:
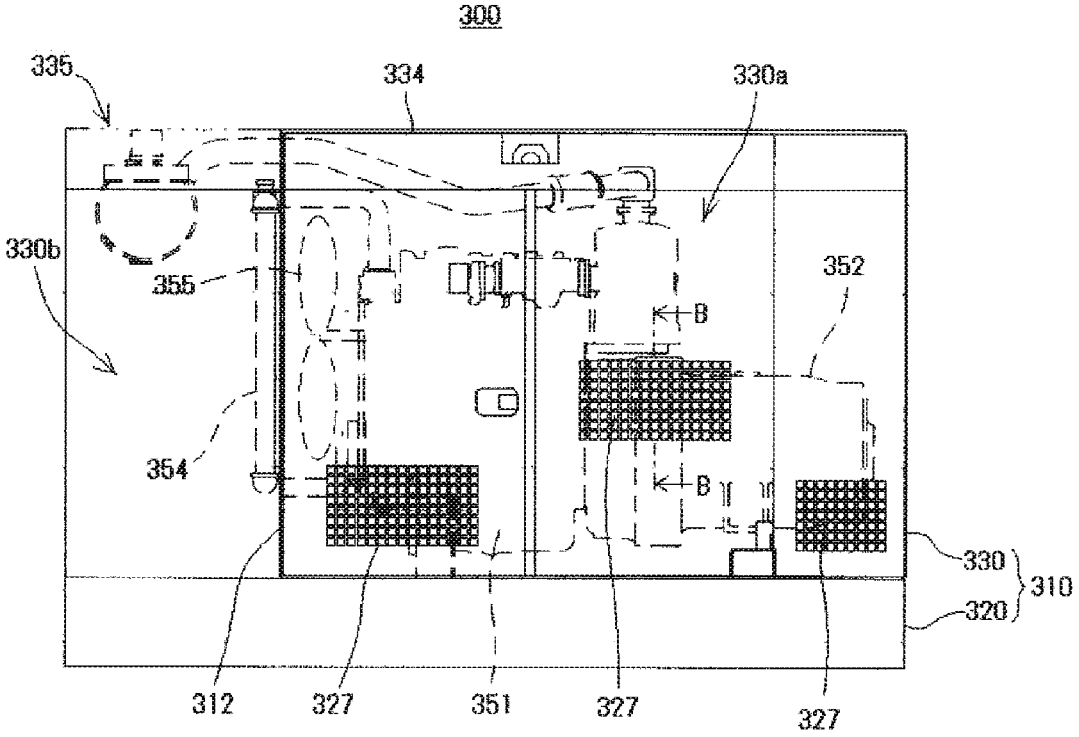
FIG. 8A RELATED ART
FIG. 8A is a side view of a conventional sound proof box for an engine-driven work machine which is provided with an air intake port on the lateral wall of a sound proof case.
Figure 8B:
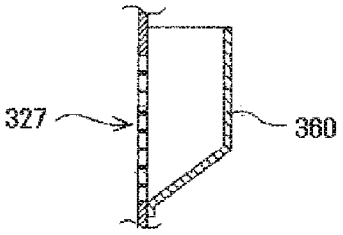
FIG. 8B RELATED ART
FIG. 8B is an enlarged B-B line cross-sectional view of FIG. 8A.
Figure 9:
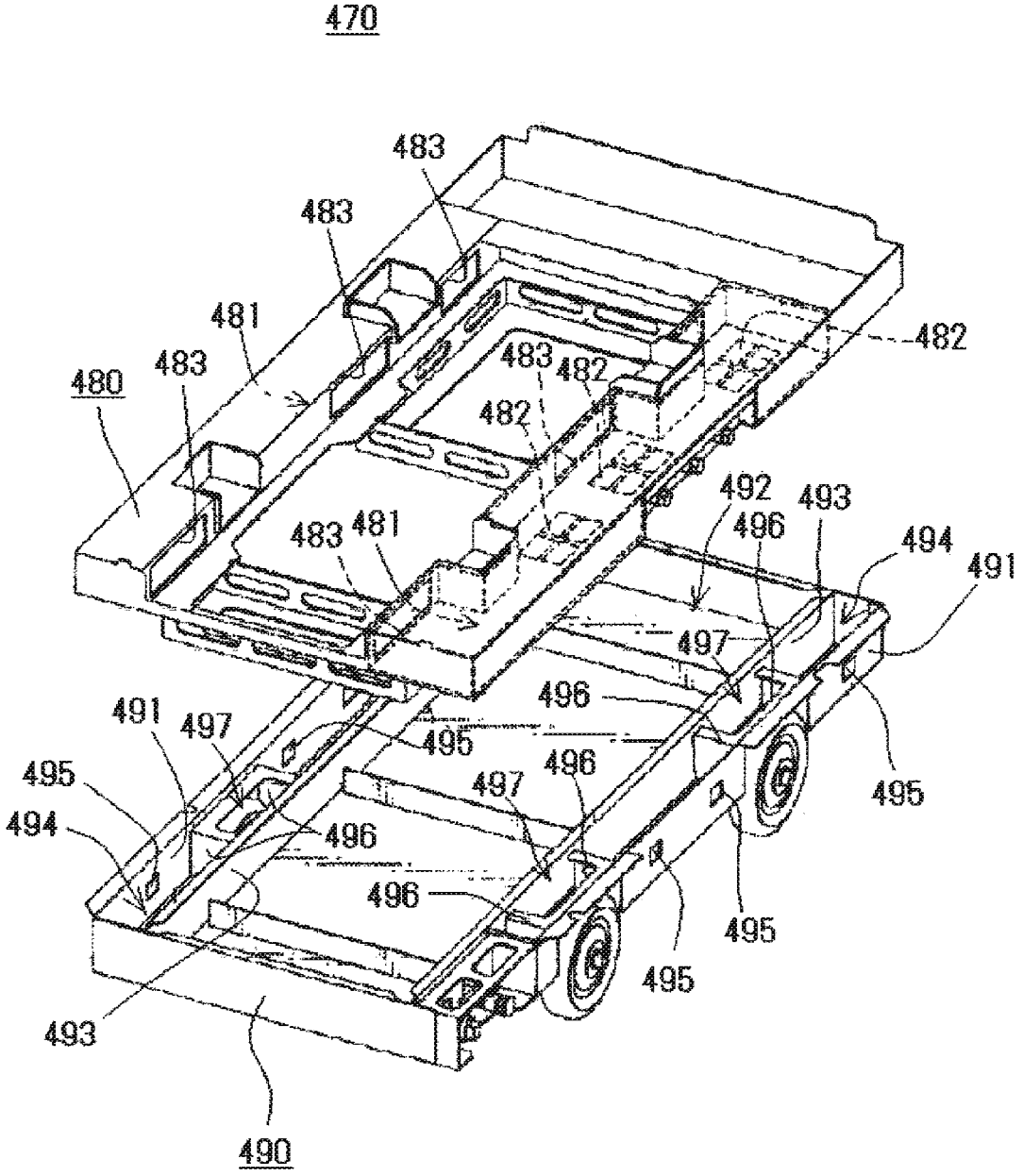
FIG. 9 RELATED ART
FIG. 9 is an exploded view of the base part of a conventional sound proof box of an engine-driven work machine wherein a cooling air introduction flow path is formed in the base (corresponding to FIG. 3 of the '219704).

The cooling air introduction flow path formed in this base 20 can introduce cooling air in an amount necessary and sufficient for cooling a heat exchanger 54, and as a result, unlike a conventional sound proof box 310 explained with reference to FIG. 7 and FIG. 8, the sound proof box 10 of the present invention does not necessarily need to be provided with an air intake port 327 on the lateral wall of a sound proof case 330, and even in the case of providing an air intake port 327 on the lateral wall of a sound proof case, the air intake ports 327 can be reduced in size and number, and therefore, it is not necessary any more to provide a duct 360 inside the position at which to form the air intake port 327, or by allowing the ducts 360 provided inside the position at which to form the air intake port 327 to be reduced in size and number, the sound proof case is allowed to be reduced in size, and further the entire of an engine-driven work machine is allowed to be reduced in size.

In addition, the aforementioned cooling air introduction flow path formed in the base 20 precludes the noise generated in the sound proof case 30 from directly leaking outside the machine through an air intake port 27, by being formed in a manner of meandering through the inside of the base 20, and the sound insulation of the sound proof box 10 cannot be compromised by the formation of the cooling air introduction path.

Moreover, the cooling air flowing through this introduction path is configured to move from the lower side to the upper side while meandering, and thereby, even if rainwater passes through the air intake port 27 by being carried by the cooling air, the rainwater is separated from the cooling air before it reaches the introduction port 15 to fall downward to be removed, and thereby even to prevent rainwater from entering the engine chamber 30*a*.

Furthermore, since the above configuration allows a cooling air introduction path to be formed without carrying out hole drilling process or the like on the upper stage portion 20*a* of the base 20 which is the part where to form an oil reservoir 23*b*, the other space (oil reservoir) 23*b* with liquid tightness can be easily obtained, for example, by separating the inside of the oil reservoir of an already existing base provided with a function of an oil weir by the separation wall 24 to form the other space (oil reservoir) 23*b*.

Furthermore, since the configuration in which an inspection port 28 is provided on one widthwise lateral wall of the upper stage portion 20*a* as described above allows the inside of a cooling air introduction flow path to be easily accessed by simply removing a cover 29, excellence in maintainability is realized in a matter and so on that dust and a foreign matter can be easily removed, even in the case where problems such as dusts accumulating or foreign matters sucked in being clogged in the cooling air introduction flow path occur.

In the configuration shown in FIGS. 1 to 6, the separation wall 24 which divides the space 23 in the upper stage portion 20*a* of the base 20 is provided at a position relatively close to a partition wall 12, and when an introduction port 15 is provided on the component arranging plate 14 between the lower end of the partition wall 12 and the upper end of the separation wall 24, the introduction port 15 necessarily opens near the blower 55.

In this configuration, the cooling air introduced into the engine chamber 30*a* can be introduced into the heat exchanger 54 in a cold state before being warmed up in the engine chamber 30*a*, thus improving the cooling performance of the engine 51.

However, the configuration of the sound proof box 10 of the present invention is not limited thereto, and the aforementioned separation wall 24 may be provided by moving it toward the inner part of an engine chamber 30*a* to a position farther than a partition wall 12, for example, a position below the constituent equipment placed in the engine chamber 30*a* which is equipment that needs to be cooled.

By making such a configuration, it is made possible to open the introduction port 15 below the equipment that is considered to need to be cooled, and therefore, cooling air can be introduced into an engine chamber 30*a* below the constituent equipment that needs to be cooled, instead of introducing cooling air near a blower 55, or together with introducing cooling air near the blower 55, to allow this equipment to be cooled.

Thus the broadest claims that follow are not directed to a machine that is configure in a specific way. Instead, said broadest claims are intended to protect the heart or essence of this breakthrough invention. This invention is clearly new and useful. Moreover, it was not obvious to those of ordinary skill in the art at the time it was made, in view of the prior art when considered as a whole.

Moreover, in view of the revolutionary nature of this invention, it is clearly a pioneering invention. As such, the claims that follow are entitled to very broad interpretation so as to protect the heart of this invention, as a matter of law.

It will thus be seen that the objects set forth above, and those made apparent from the foregoing description, are efficiently attained and since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described;

EXPLANATION OF REFERENCE NUMERALS

1 Engine-driven work machine
10 Sound proof box
12 Partition wall
13 Communication port
14 Component arranging plate
14*a* End edge on the side of engine chamber (of component arranging plate)
15 Introduction port (for cooling air)
16 Mesh-like cover
17 Frame body
20 Base
20*a* Upper stage portion (of base)
20*b* Lower stage portion (of base)
211 One longitudinal lateral wall (of base)
212 The other longitudinal lateral wall (of base)
213 One widthwise lateral wall (of base)
214 The other widthwise lateral wall (of base)
211*a* One longitudinal lateral wall (of upper stage portion of base)
212*a* One longitudinal lateral wall (of upper stage portion of base)
213*a* The other longitudinal lateral wall (of upper stage portion of base)
214*a* The other longitudinal lateral wall (of upper stage portion of base)
211*b* One widthwise lateral wall (for lower stage portion of base)
212*b* One widthwise lateral wall (for lower stage portion of base)
213*b* The other widthwise lateral wall (for lower stage portion of base)
214*b* The other widthwise lateral wall (for lower stage portion of base)
22 Floor plate
23 Space (in upper stage portion)
23*a* One space
23*b* The other space (oil reservoir)
24 Separation wall
25 Through hole
26 Arranging table
27 Air intake port
28 Inspection port
29 Cover
30 Sound proof case
30*a* Engine chamber
30*b* Air discharging chamber
31 Front panel
32 Rear panel
33 Side panel
34 Top panel
35 Air discharging port
51 Engine
52 Work machine main body (compressor main body)
53 Receiver tank
54 Heat exchanger

55 Blower
300 Engine-driven work machine
310 Sound proof box
312 Partition wall
320 Base
327 Air intake port
330 Sound proof case
330*a* Engine chamber
330*b* Air discharging chamber
334 Top panel
335 Air discharging port
351 Engine
352 Work machine main body (generator main body)
354 Heat exchanger
355 Cooling fan
360 Duct
470 Base
480 Bed
481 Sack-shaped flow paths
482, 483 Opening
490 Oil guard
491 Outer wall (of oil guard) in the longitudinal direction
492 Oil reservoir
493 Lateral wall (of fuel tank)
494 Duct
495 Air intake port
496 Partition plate
497 Space (of wheel upper portion)

What is claimed is:

1. A sound proof box for an engine-driven work machine comprising a base arranging an engine and a work machine main body driven by the engine and an upper portion of which is opened, and a sound proof case for covering the upper side of the base, and a space in the sound proof case being separated into two chambers by a vertically erected partition wall to make one chamber as an engine chamber storing the engine and the work machine main body and to make the other chamber as an air discharging chamber introducing the cooling air from the engine chamber through a communication port provided on the partition wall and discharging to outside of the machine through an air discharging port, an upper opening of the base being covered with a component arranging plate at a position at which to place the air discharging chamber, to form a bottom surface of the air discharging chamber by the component arranging plate, an inside of the base being separated into an upper stage and a lower stage by a floor plate at a predetermined position in the height direction to make a side of the upper stage of the base which includes the floor plate as an upper stage portion and make a part lower than the floor plate of the base as a lower stage portion, a separation wall to divide a space in the upper stage portion in the longitudinal direction being provided at a position below the engine chamber to make the space in the upper stage portion which is a space closer to the air discharging chamber than the separation wall as one space, a cooling air introduction port which communicates the engine chamber with the one space being provided between the partition wall and the separation wall, a through hole which communicates the one space with a space in the lower stage portion being provided at a bottom portion of the one space at a position below the air discharging chamber, and a cooling air intake port which communicates the space in the lower stage portion with the outside of the machine being provided on a lateral wall of the lower stage portion.

2. The sound proof box for an engine-driven work machine according to claim 1 wherein each of the upper stage portion and the lower stage portion is formed as a discrete member, and that the base is formed by arranging the upper stage portion on the lower stage portion.

3. The sound proof box for an engine-driven work machine according to claim 1 wherein the air intake port which is also used as a fork insertion port of a forklift is provided on the lateral wall of the lower stage portion which is the longitudinal lateral wall thereof.

4. The sound proof box for an engine-driven work machine according to claim 2 wherein the air intake port which is also used as a fork insertion port of a forklift is provided on the lateral wall of the lower stage portion which is the longitudinal lateral wall thereof.

5. The sound proof box for an engine-driven work machine according to claim 1 wherein the introduction port is covered with a mesh-like cover.

6. The sound proof box for an engine-driven work machine according to claim 2 wherein the introduction port is covered with a mesh-like cover.

7. The sound proof box for an engine-driven work machine according to claim 3 wherein the introduction port is covered with a mesh-like cover.

8. The sound proof box for an engine-driven work machine according to claim 1 wherein a space in the upper stage portion divided by the separation wall which is the other space therein is formed as a liquid-tight chamber to make an oil reservoir for reserving leaked oil.

9. The sound proof box for an engine-driven work machine according to claim 2 wherein a space in the upper stage portion divided by the separation wall which is the other space therein is formed as a liquid-tight chamber to make an oil reservoir for reserving leaked oil.

10. The sound proof box for an engine-driven work machine according to claim 3 wherein a space in the upper stage portion divided by the separation wall which is the other space therein is formed as a liquid-tight chamber to make an oil reservoir for reserving leaked oil.

11. The sound proof box for an engine-driven work machine according to claim 4 wherein a space in the upper stage portion divided by the separation wall which is the other space therein is formed as a liquid-tight chamber to make an oil reservoir for reserving leaked oil.

12. The sound proof box for an engine-driven work machine according to claim 5 wherein a space in the upper stage portion divided by the separation wall which is the other space therein is formed as a liquid-tight chamber to make an oil reservoir for reserving leaked oil.

13. The sound proof box for an engine-driven work machine according to claim 1 wherein an inspection port is provided in the part of the lateral wall of a base in which the one space is formed, and that a cover for covering the inspection port is provided.

14. The sound proof box for an engine-driven work machine according to claim 2 wherein an inspection port is provided in the part of the lateral wall of a base in which the one space is formed, and that a cover for covering the inspection port is provided.

15. The sound proof box for an engine-driven work machine according to claim 3 wherein an inspection port is provided in the part of the lateral wall of a base in which the one space is formed, and that a cover for covering the inspection port is provided.

16. The sound proof box for an engine-driven work machine according to claim 5 wherein an inspection port is provided in the part of the lateral wall of a base in which the one space is formed, and that a cover for covering the inspection port is provided.

17. The sound proof box for an engine-driven work machine according to claim 8 wherein an inspection port is provided in the part of the lateral wall of a base in which the one space is formed, and that a cover for covering the inspection port is provided.

* * * * *